United States Patent [19]

Hudec et al.

[11] 4,289,665

[45] Sep. 15, 1981

[54] PROCESS FOR THE PREPARATION OF AQUEOUS EMULSIONS, STABLE IN STORAGE, OF N.ALKYL-N-ALKYLOL-UREAS AND THEIR APPLICATION FOR THE SOFTENING OF LEATHER

[75] Inventors: Gustav Hudec, Schwalbach; Karl-Heinz Keil, Offenbach-Bieber; Volker Köhler, Niedernhausen; Kurt Rosenbusch, Frankfurt am Main, all of Fed. Rep. of Germany

[73] Assignee: Cassella Aktiengesellschaft, Frankfurt am Main-Fechenheim, Fed. Rep. of Germany

[21] Appl. No.: 67,273

[22] Filed: Aug. 17, 1979

Related U.S. Application Data

[63] Continuation-in-part of Ser. No. 970,224, Dec. 18, 1978, abandoned.

[30] Foreign Application Priority Data

Dec. 23, 1977 [DE] Fed. Rep. of Germany ..... 2757582

[51] Int. Cl.[3] ..... D06M 13/40; D06P 5/00; C14C 9/00

[52] U.S. Cl. ..... 260/21; 8/94.1 R; 8/115.6; 8/185; 252/8.57; 260/28 R; 260/29.4 R; 260/30.4 N; 260/30.8 R; 260/32.8 N; 260/33.2 R; 260/33.4 R; 260/33.8 R

[58] Field of Search ..... 252/8.57; 260/553 R, 260/553 A, 21, 28; 8/115.6, 185, 94.1 R

[56] References Cited

U.S. PATENT DOCUMENTS

| | | | |
|---|---|---|---|
| 2,165,265 | 7/1939 | Hubert et al. | 91/70 |
| 2,211,976 | 8/1940 | Hubert et al. | 91/70 |
| 2,361,185 | 10/1944 | Engelmann et al. | 260/553 R |
| 3,147,138 | 9/1964 | Mueller et al. | 252/8.57 |
| 3,510,245 | 5/1970 | Wolfe | 8/94.21 |
| 3,859,351 | 1/1975 | Keller et al. | 260/553 R |
| 3,920,868 | 11/1975 | Hammer et al. | 427/354 |
| 3,931,080 | 1/1976 | Hammer et al. | 260/29.4 R |
| 3,965,015 | 6/1976 | Bauman | 252/8.75 |
| 3,983,043 | 9/1976 | Brandeis et al. | 260/553 R |
| 4,149,979 | 4/1979 | Hudec et al. | 252/8.75 |

*Primary Examiner*—John C. Bleutge
*Assistant Examiner*—H. J. Lilling
*Attorney, Agent, or Firm*—Connolly and Hutz

[57] ABSTRACT

An agent for conditioning and imparting water repellency to leather comprises a homogeneous mixture of (a) 10 to 35% by weight of a compound of the formula

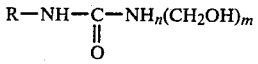

wherein R is linear or branched alkyl or alkenyl each having 14 to 22 carbon atoms, m is a number average from 1.0 to 1.5 and n is 2 minus m;

(b) 0 to 10% by weight of non-ionic emulsifiers;

(c) 0 to 3% by weight of anionic emulsifiers with the proviso that the sum of (b) and (c) is 0.5 to 10%;

(d) 0 to 5% by weight of an epoxide of the formula

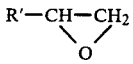

wherein R′ is alkyl or alkenyl having 15 to 40 carbon atoms;

(e) 0 to 25% by weight of fat liquors; and (f) 25 to 89.5% by weight of water or a water-miscible organic solvent.

11 Claims, No Drawings

PROCESS FOR THE PREPARATION OF AQUEOUS EMULSIONS, STABLE IN STORAGE, OF N.ALKYL-N-ALKYLOL-UREAS AND THEIR APPLICATION FOR THE SOFTENING OF LEATHER

This is in part a continuation of application Ser. No. 970,224 filed Dec. 18, 1978 now abandoned.

The present invention relates to conditioning and water-repellency agents for leather, consisting of 10 to 35% by weight of a compound of the general formula I $$R—NH—CO—NH_n(CH_2OH)_m \quad (I)$$

wherein

R denotes linear or branched alkyl or alkenyl with 14–22 C atoms and m denotes a number from 1.0 to 1.5 and n=2−m;

b % of known non-ionic emulsifiers and c % of known anionic emulsifiers, with b=0 to 10 c=0 to 3 and b+c=0.5 to 10;

0 to 5% by weight of an epoxide of the formula II

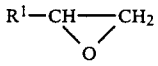

(II)

wherein $R^1$ denotes alkyl or alkenyl with 15 to 40 C atoms;

0 to 25% by weight of known fat liquors and 25 to 89.5% by weight of water or a water-miscible organic solvent, their preparation and use.

Conditioning agents are intended to impart advantageous surface active properties, in particular a pleasant, warm handle, to leather. Known conditioning agents are for example natural oils and partially saponified natural fats.

Besides the conditioning effect it is frequently desired that an imparting of water-repellency to the leather be brought about. Known possibilities for the imparting of water-repellency to leather are the treatment with solutions or emulsions of paraffin hydrocarbons, waxes or the like. Metal soaps, too have already been used for purposes of imparting water-repellency, as well as combinations of metal salts and paraffin emulsions and wax emulsions. Metal complexes which, similarly to metal soaps, may be used for purposes of imparting water-repellency are known from U.S. Pat. No. 2,273,040. Further known water-repellent agents are the N-alkyl-N'-ethylene ureas with long-chain alkyl radical which are known from German Patent No. 681,520.

The known products, however, have a series of disadvantages: thus e.g. their unsatisfactory resistance to water combined with their inadequate wet-fastness and fastness to washing and, associated with this deficiency, a lessening of reactivity during longer storage, not always adequate effect in imparting water-repellency. Further disadvantages of known products are for example unsatisfactory compatibility with other finishing agents for leather or with dyestuffs, which fact may lead to changes of shade of dyeings, nonuniformly good effect on different materials, as for example vegetable tanned or chrome-tanned leather, unsatisfactory stability of the water-repellency and brightening effects vis-a-vis dry cleaning and "greasiness" then applied to suede leather.

The present invention now relates to brightening and water-repellency agents which give an excellent improvement of handle of leather with simultaneously outstanding water-repellency effects. The effects achieved have a very good resistance to wetting, washing and dry cleaning and the effects can be achieved on very diverse qualities of leather. Moreover, the substrate-reactive active substances of the formula I which are contained in the brightening and water-repellent agents to be used according to the invention can be prepared in industrially simple manner.

The brightening and water-repellent agents which are to be used according to the invention for leather, consist of 10 to 35% by weight of a compound of the general formula I $$R—NH—CO—NH_n(CH_2OH)_m \quad (I)$$

wherein

R denotes linear or branches alkyl or alkenyl with 14–22 C atoms and m denotes a number from 1.0 to 1.5 and n=2−m;

b % by weight of known non-ionic emulsifiers and c % by weight of known anionic emulsifiers, with b=0 to 10 c=0 to 3 and B+C=0.5 to 10;

0 to 5% by weight of an epoxide of the formula II

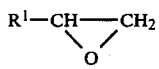

(II)

wherein $R_1$ denotes alkyl or alkenyl with 15 to 40 C atoms;

0 to 25% by weight of known fat liquors and 25 to 89.5% by weight of water or a water-miscible organic solvent.

Particularly favourable properties are possessed by auxiliary agents according to the invention with 10 to 25% by weight of the active substance of the formula I and 1 to 5% by weight of non-ionic and/or anionic emulsifiers.

The long-chain alkyl radicals R of the active substances of the formula I which are contained in the auxiliary agent preparations according to the invention and which have 14 to 22 carbon atoms are preferably only weakly branched or linear. Examples of alkyl radicals which in the active substances of the formula I may stand for R are: decyl, undecyl, duodecyl, 8-ethyldecyl(10), tridecyl, tetradecyl, pentadecyl, hexadecyl, heptadecyl, octadecyl, 6-hexyl-duodecyl(12), nonadecal, eicosyl, heneicosyl, docosyl, tricosyl, tetracosyl, pentacosyl, hexacosyl, heptacosyl, octacosyl, triacontyl.

Both in regard to the effect, emulsifiability and technical service properties and for reasons of ready accessibility of the appropriate starting materials, those mixtures of compounds according to the invention of the formula I are likewise preferred in which the radicals R in regard to their number of carbon atoms and their molar proportion in the mixture correspond to the statistical composition of the carboxylic acids in natural fats, such as tallow, coconut oil, stearin, soya bean oil or palm oil. Radicals R which stand for such a group of alkyl radicals are usually designated as tallow fatty alkyl, coconut fatty alkyl, etc. Thus, for example "stearylalkyl" consists substantially of alkyl radicals with 16 to 18 carbon atoms, "tallow fatty alkyl" consists substantially of alkyl radicals with 14, 16, 18 carbon atoms and the octadecen-(9)-yl-(1) radical, and "oleyl-alkyl" consist substantially of alkyl radicals with 16–18 carbon atoms and the octadecen-(9)-yl-(1) radical.

The active substances of the formula I which are to be used according to the invention behave particularly favourably in regard to their joint use along with other agents necessary for leather treatment or finishing and in regard to their emulsifiability with non-ionic and anionic emulsifiers in aqueous liquors. This advantageous property of the active substances contained in the conditioning and water-repellent agents according to the invention opens up the possibility to vary widely the emulsifier required for the emulsification of the active substance in water.

It is also certainly expedient to utilise this possibility and adapt it to the possible contemplated main type of leather.

The know-per-se non-ionic emulsifiers contained in the conditioning and water-repellent agents of the present invention may be summarised under the general formula III $$A-(OCH_2-\underset{\underset{R^4}{|}}{CH})_n-OH \qquad \text{(III)}$$

wherein

A is unbranched alkyl or alkenyl with 10 to 22 C atoms, alkylphenyl, dialkylphenyl or trialkylphenyl each with a total of 2 to 12 C atoms in the alkyl radicals, $R^4$ is hydrogen or alkyl with 1 to 2 C atoms and n is a number between 8 and 14, preferably between 10 and 12.

Non-ionic emulsifiers of the general formula III stated above are obtained through reaction of hydroxyl-group-containing compounds AOH with 8 to 14 moles of alkylene oxides such as butylene, propylene and preferably ethylene oxide.

Hydroxyl group-containing organic compounds AOH which are suitable for preparing the non-ionic emulsifiers contained in the auxiliary agent preparations according to the invention are for example long-chain alkanols and alkenols with 10 to 22 carbon atoms, in particular those which derive from the natural fatty acids, such as stearic acid, palmitic acid, oleic acid or the natural fatty acid mixtures, such as are present in coconut fatty acid or stearic acid and synthetic alcohols with a $C_{10}$ to $C_{15}$ alkyl chain distribution; alkylphenols, dialkylphenols and trialkylphenols with 4–9 carbon atoms in each alkyl radical and having a total of 4–12 carbon atoms in the alkyl radicals, as for example p-tert.-butylphenol, p-nonylphenol, tri-isopropyl and tri-isobutyl phenols, for example 2,4,6,-tri(n)-butylphenol, 2,4,6,-tri-isobutylphenol or 2,4,6-tri-tert.-butylphenol. Known anionic emulsifiers used in the industrial leather processing procedures are for example sulphated fats or oils, such as e.g. sulphated train oil or sulphated sperm oil, palm oil or neat's foot oil; sulphonated or sulphated paraffin hydrocarbons, chloroparaffin hydrocarbons, olefins, fatty alcohols with a chain length of 10–30 C atoms, their salts and their derivatives chemically modified at the sulphonic acid group, such as sulphotaurides, sulphoamides or imides, sulpho esters; chemically modified fatty acids with 10–50 C atoms, such as e.g. fatty acid taurides, oxethanesulphonates; alkylarylsulphonic acid or its salts with an alkyl radical with 5 to 30 C atoms.

Further anionic emulsifiers which contain at least one —$OSO_3H$— or a —$SO_3H$—group are e.g. the sulphuric acid semi-esters of non-ionic emulsifiers based on ethylene oxide adducts to OH-group-containing organic compounds which, where appropriate, were subsequently converted into the salts through neutralisation with inorganic bases, such as e.g. NaOH, $Na_2CO_3$ or with organic amines, such as e.g. diethanolamine, ethanolamine or triethanolamine. As starting compounds based on ethylene oxide, the following are suitable: reaction products of 4-nonylphenol, 2,4,6-tritertiarybutylphenol, 4-benzyl-2'-hydroxy-diphenyl, 2-benzyl-2'-hydroxydiphenyl with 8–30 moles of ethylene oxide, reaction products of ethoxylated alkanols based on natural products, such as stearyl alcohol, coconut fatty alcohol, tallow fatty alcohol and oleyl alcohol, with 8–30 moles of ethylene oxide. It is also possible to use emulsifiers which are obtained when stearoyl chloride, oleyl chloride or coconut fatty acid chloride are reacted with taurine or N-methyl taurine to give the appropriate taurides.

The agents according to the invention which contain the above-described emulsifiers and mixtures of these emulsifiers possess very good technical service properties and show an optimum fine particle size of the emulsified active substances and thus a high stability in storage of the emulsions. In particular, it has been found that, through the combination of the non-ionic with the anionic emulsifiers which possess in their molecule at least one —$OSO_3H$— or a —$SO_3H$—group in the form of the alkali metal salt, $NH_4^+$- or alkyl-ammonium or tri-alkanol-ammonium, preferably tri-ethanol-ammonium salts, it is possible to increase the fine dividing of the claimed active substances to such an extent, that, in the case of dilution to 1 to 0.1% solutions, colloidal solutions result.

Particularly preferred for the combination with anionic emulsifiers are non-ionic emulsifiers of the general formula III wherein A is unbranched or little branched alkyl or alkenyl with 10–22 C atoms.

The good compatibility of the active substances of the formula I which are contained in the auxiliary agents according to the invention also enables their use conjointly with epoxides of the formula II. Agents according to the invention may contain 0.5 to 5% by weight of the epoxides of the formula II. Preferred auxiliary agent preparations according to the invention are free from epoxides of the formula II.

With the auxiliary agent preparations according to the invention it is also possible, simultaneously with the conditioning and imparting of water-repellency to the leather, to effect the fat-liquoring of the leather with a fat liquor. In this case it is also possible to work directly into the auxiliary agent preparations according to the invention at least a part of the fat liquor required for the fat-liquoring of the leather. This fat liquor proportion replaces as a rule a part of the emulsifiers contained in the auxiliary agent preparations to be used according to the invention. It is readily possible to replace up to 25% by weight of the emulsifier by fat liquor. In such a conditioning and water-repellent agent according to the invention which contains fat liquor the emulsifier accordingly consists of 95.0 to 37.5% by weight of known non-ionic emulsifiers, 0 to 50% by weight of known anionic emulsifiers and 5 to 25% by weight of known fat liquors. Preferably, the emulsifier of the auxiliary agents contains 90 to 60% by weight of known non-ionic emulsifiers, 0 to 20% by weight of known anionic emulsifiers and 10 to 20% by weight of known fat liquors.

Of the known fat liquors described e.g. in "Ullmanns Enzyklopädie der technischen Chemie", Volume 11, page 567, the products which are built up on the basis of anion-active components and are free from cationic substances can, within the scope of the particulars given above, be worked into the brightening and water-repellent agents according to the invention.

In the case of the fat liquors, a distinction is made between the classic fat liquor systems which are built up from emulsifiers, neutral oils, neutral fats and buffer systems and the synthetic and semi-synthetic fat liquor systems.

Suitable for the classic fat liquors are fat-liquoring substances on a vegetable and animal basis, such as e.g. tallow, train oil, sperm oil, neat's foot oil, castor oil, olive oil, linseed oil, stearin, wool fat; waxes, such as beeswax, carnauba wax or montan wax as well as mineral oil and linear chloroparafins with 18–30 C atoms and 10–50% by weight chain chlorine. In order to be able to apply these classic fat-liquoring agents as fat liquors, 2 possibilities offer themselves, through partial reaction with monohydrate or sulphuric acid, to prepare sulphonated, semi-synthetic, readily emulsifiable systems or conversion into an emulsified form with emulsifiers or emulsifier mixtures in the form of non-ionic or preferably anionic compounds. Today, however, for the fat-liquoring of leather there are increasingly used synthetic products which have emulsifier properties and simultaneously have a fat-liquoring effect.

Examples of groups of synthetic compounds which, in part, in combination with the above-mentioned water-insoluble natural and synthetic fat-liquoring agents, in part also by themselves, may be contained as fat liquors in conditioning and water-repellent agents of the present invention, are:

fatty acid esters of $\beta'$hydroxyethanesulphonic acid, e.g.

$$CH_3-(CH_2)_{16}-CO-O-CH_2-CH_2-SO_3\oplus Na\ominus \text{ and}$$

$$CH_3-(CH_2)_7-CH=CH-(CH_2)_7-CO-O-CH_2-CH_2SO_3\oplus Na\ominus;$$

fatty acid derivatives of aminoacetic acid, e.g.

$$CH_3-(CH_2)_{16}-CO-NH-CH_2-COO\oplus Na\ominus$$

fatty acid taurides and fatty acid N-methyltaurides, e.g.

$$CH_3-(CH_2)_7-CH=CH-(CH_2)_7-CO-\underset{\underset{CH_3}{|}}{N}-CH_2-CH_2-SO_3\ominus Na\oplus;$$

synthetic sulphochlorination products, e.g.

$$CH_3-CH_2-\underset{\underset{SO_2Cl}{|}}{CH}-CH_2-CH_2-\underset{\underset{SO_2Cl}{|}}{CH}-(CH_2)_6-CH_3;$$

secondary sulphonates-alkali metal salts, e.g.

$$CH_3-CH_2-\underset{\underset{SO_3Na}{|}}{CH}-(CH_2)_9-CH_3;$$

long-chain sulphamides, e.g.

$$CH_3-CH_2-\underset{\underset{SO_2-\underset{\underset{CH_3}{|}}{N}-CH_2-CH_2-SO_3\ominus Na\oplus}{|}}{CH}-(CH_2)_{12}-CH_3;$$

sulphoxidation products of predominantly saturated unbranched paraffins, e.g.

$$C_{18}H_{37}-SO_3Na,$$
$$C_{18}H_{37}-SO_2-NH-CH_2-COO\ominus Na\oplus \text{ or}$$
$$C_{18}H_{37}-SO_2-\underset{\underset{CH_3}{|}}{N}-CH_2-CH_2-SO_3\ominus Na\oplus;$$

alkyl-aryl-sulphonates and olefin-sulphonates.

In order to facilitate the application, the handling and the metered feed of the auxiliary agent preparations according to the invention, it is expedient to add to the mixtures consisting of active substance according to the invention of the formula I, emulsifier and, where appropriate, epoxides of the formula II, such an amount of water or water-miscible organic solvents that the resulting products, in regard to the active substance of the formula I, have a content of 10 to 75% by weight.

Water-miscible organic solvents which may be contained in the auxiliary agent preparations according to the invention are lower alkanols, as for example methanol, ethanol, propanol, isopropanol; ketones, such as acetone, diethyl ketone, methylethyl ketone; cyclic ethers, such as tetrahydrofuran or dioxan; lower acid amides, as for example acetamide or dimethylformamide, dimethylacetamide, dimethylsulphoxide, glycolmonomethyl or glycoldimethyl ether or diglycolmonomethyl or diglycoldimethyl ether. Particularly preferred for the stated purpose is water. Of the organic solvents, the lower alkanols, in particular ethanol, and the propanol are preferred.

The preparation of the brightening and water-repellency agents according to the invention may in principle be effected through homogenisation of the N-methylol-N'-alkylureas of the formula I, which are to be regarded as main active substances of the preparation, with the non-ionic and/or anionic emulsifiers of the nature described above or with epoxides of the formula II or known fat liquors.

Expediently, however, the N-methylol-N'-alkylureas of the formula I are prepared immediately before the production of the preparations according to the invention through methylolisation of the appropriate N-alkylureas of the formula IV $$R-NH-CO-NH_2 \qquad (IV)$$

The methylolisation may in principle be carried out according to all known methods through reaction of the urea derivatives with formaldehyde, or agents which split off formaldehyde, at temperatures between room temperature and about 150° C. Ureas of the formula IV may be methylolated particularly advantageously through reaction with paraformaldehyde in the melt or with aqueous formaldehyde solution in a water-immiscible organic solvent. In this process the reaction temperatures lie between 60° and 150° C. When carrying out the methylolisation reaction in the melt, the work is preferably effected between 100° and 130° C.; when carrying out the methylolisation reaction in an inert, water-immiscible organic solvent the work, with an eye to as high a reaction speed as possible, is carried out in the proximity of the boiling point of the solvent, in particular at reflux temperature of the reaction mixture. As aqueous formaldehyde solution, expediently the commercial, concentrated aqueous formaldehyde solution with a content of about 39% is used. Inert, water-immiscible organic solvents which are suitable for the carrying out of the methylolisation are for example petroleum fractions with a boiling point between 60° and 150° C., preferably 80° and 110° C., halogen hydrocarbons, as for example carbon tetrachloride, trichloroethylene, perchloroethylene, dichloroethane or tetrachloroethane; in particular, however, aromatic hydrocarbons, such as benzene, toluene and the xylenes as well as halogen hydrocarbons, as for example monochlorobenzene. In the case of the use of organic solvents with lower boiling points, in particular boiling points below 60° C., as for example chloroform or methylene chloride, a substantial lengthening of the duration of methylolisation has to be accepted.

It is known that methylolisation reactions are catalysed by acids and bases. For the preparation of the compounds of the formula I it is advantageous to work under the pH values between 5 and 9, preferably between 7 and 8.5, described for example in French Pat. No. 1,374,705. The pH value from 5 to 9 may be set up through addition of weak organic or inorganic acids or bases to the methylolisation mixture. The preferred pH range of 7 to 8.5 is achieved through addition of weak inorganic or organic bases. Suitable inorganic bases are for example sodium hydrogen carbonate or sodium carbonate in the form of concentrated aqueous solutions. Particularly advantageous is the use of organic, non-methylolatable bases. As such, suitable in particular are low-odour, little-volatile tertiary amines, such as e.g. triethanolamine, N-methylmorpholine, N-β-hydroxyethylmorpholine, N-methylthiomorpholine, N-β-hydroxyethylthiomorpholine and N,N-dimethylethanolamine. After completion of methylolation, the compounds of the formula I which were obtained in the melt may be used directly without further purification operations for the production of the preparations according to the invention. When carrying out the methylolation in an organic solvent the latter, after completion of the methylolation, is distilled off azeotropically together with the water contained in the aqueous formaldehyde solution.

It has proved particularly advantageous to add to the reaction mixture, before or during the methylolation reaction, a part or the whole amount of the emulsifiers to be worked into the brightening and water-repellent agents according to the invention. Here, after completion of the methylolation reaction and, where appropriate, the distilling off of organic solvent and water, there are obtained products which are emulsifiable directly in water and which have a good fine-particle size of the N-methylol-N'-alkylureas of the formula I and possess an exceptionally high stability and outstanding effectiveness.

The preparation of the N-methylol-N'-alkylureas of the formula I from the N-alkyl ureas of the formula IV may also be effected immediately following the preparing of these ureas from the appropriate alkylisocyanates. This procedure offers particular advantages when the methylolation is carried out in an organic solvent. In this case it is expedient to use the same organic solvent for the reaction of the isocyanates with ammonia to give the ureas of the formula IV and for the subsequent methylolation of the ureas. In this case, the reaction mixtures which were obtained in the reaction of the isocyanates with $NH_3$ may be used for the subsequent methylolation without intermediate isolation of the ureas of the formula IV.

The amount of formaldehyde or paraformaldehyde to be used in the methylolation is governed by the desired methylolation degree m of the methylolalkylureas of the formula I which are to be prepared. The methylolation degree m should lie between 1 and 1.5. Accordingly, at least 1 to 1.5 moles of formaldehyde or paraformaldehyde are used per mole of the urea of the formula IV. As a rule, an excess of 20–50% is necessary. Depending on whether the methylolation has already been carried out in the presence of a part or the total amount of the emulsifiers contained in the conditioning agent of the present invention, products are obtained which contain no emulsifier or a partial amount or the total amount of the emulsifiers. After completion of the methylolation reaction, the residual amounts of emulsifier and, if desired, epoxides of the formula II or known fat liquors, are then homogenised with the products of the methylolation reaction and, finally, the products obtained are adjusted to a total solids content of 10 to 75% through addition of water or water-miscible organic solvents. In order to prepare in each case 100 g of brightening and water-repellent agents according to the invention, 0 to 10 parts by weight of non-ionic and 0 to 3 parts by weight of anionic emulsifiers are used; the total amount of the emulsifiers is 0.5 to 10 parts by weight.

The amount of the urea of the formula IV to be used for the preparation of 100 parts by weight of a conditioning and water-repellent agent according to the invention results from the amount a of the therein contained N-methylol-N'-alkylurea of the formula I in that this amount is multiplied with the factor $M/(M+30m)$, wherein M is the molecular weight of the alkylurea used of the formula IV and m is the methylolation degree. There may be worked in, besides the above-mentioned emulsifiers, epoxides of the formula II, wherein R has the above-mentioned meanings, in an amount of 0 to 5 parts by weight for each 100 parts by weight of conditioning and water-repellent agents according to the invention. Known fat liquors are worked in and homogenised in an amount of 0 to 25 parts by weight with reference to each 100 parts by weight of conditioning agent which is to be prepared. The working in and homogenisation of the individual constituents of the conditioning and water-repellent agents according to the invention are effected in known-per-se manner through kneading or stirring in the plastic or molten state. As a rule, a temperature between 50° and 120° C., preferably 60° to 100° C., is necessary for this purpose. The work is carried out particularly advantageously with a high-speed stirrer with which the solid components are first homogenised in the upper part of the stated temperature range; then, in the middle to lower part of the stated temperature range, the desired amount of water or water-miscible solvent, preferably preheated to about the temperature of the previously prepared solids mixture, is metered in gradually, as a rule in the course of 20 to 200 minutes.

According to the above statements, the conditioning agents according to the invention are therefore prepared in that (a·M)/(M+30m) parts by weight of a urea of the formula IV $$R—NH—CO—NH_2 \quad (IV)$$

are methylolated under known-per-se conditions with at least the m-fold molar amount of either paraformaldehyde, calculated as formaldehyde, in the melt or aqueous formaldehyde solution in the presence of an inert, water-immiscible solvent in the presence of o parts by weight of known non-ionic emulsifiers and
p parts by weight of known anionic emulsifiers,
a water-immiscible inert solvent possibly present is distilled off and the residue is homogenised in the plastic or molten state with
(b-h) parts by weight of known non-ionic emulsifiers and
(c-p) parts by weight of known anionic emulsifiers,
d parts by weight of an epoxide of the above formula II and
e parts by weight of known fat liquors, and subsequently
f parts by weight of water or a water-miscible organic solvent are added with constant admixing and homogenisation is again effected;

$$a+b+c+d+e+f=100$$

$$a=10 \text{ to } 35$$

$$b=0 \text{ to } 10$$

$$C=0 \text{ to } 3$$

$$B+c=0.5 \text{ to } 10$$

$$d=0 \text{ to } 5$$

$$e=0 \text{ to } 25$$

$$f=25 \text{ to } 89.5,$$

$$h \leqq b \text{ and } p \leqq c.$$

The application of the conditioning and water repellent agents according to the invention is effected in known-per-se manner such as is usual in leather treatment processes. By reason of the excellent compatibility of the active substances of the formula I which are contained in the auxiliary agents according to the invention with other known auxiliary and finishing agents for leather, the conditioning and imparting of water-repellency may also be effected simultaneously with other after-treatment steps or finishing steps in one bath. For this purpose, the auxiliary agent preparations according to the invention may also be used simultaneously with dyebaths which contain leather dyestuffs besides the pertinent dyeing auxiliaries, such as dispersing agents, neutral salts and possibly additives which determine the pH value of the liquors.

The application of the conditioning and water repellent agent liquors according to the invention to leather is effected, as is generally usual in the leather industry, at temperatures between 15° and 70° C., preferably with continuous milling for 15–60 minutes in a rotating milling drum; 2–15% of the agents according to the invention in 20 to 1000% of aqueous liquor, with reference to the leather weight, are used. The treatment may, however, also be effected through spraying the leather with the treatment liquor, which may contain, besides the conditioning and water-repellent agents, further auxiliary agents necessary within the scope of leather finishing, as for example fat-liquoring agents or lacquers, and subsequent fixing of the reactive active substance according to the invention through a heat treatment at 50° to 120° C., where appropriate under pressure, for example in a tailor's press.

The leather impregnation with the auxiliary agents according to the invention may also be very conveniently effected from hot or cold aqueous solutions in the padding machines known from the textile field which recently are establishing themselves in the leather industry too, up to now chiefly for leather dyeing.

Between 20–30 g/liter are used. After the impregnation and squeezing, the leather is dried and, as described in the case of spray impregnation, hot fixed at 50°–120° C.

In exceptional cases, particularly when it is a question of already made-up leather articles, the aqueous solution of the water-repellent agent may also be carried out by brushing on by hand of by brushing machines; the penetration of the dispersion into the interior of the leather is assisted through addition of 0–50% of a so-called penetrator, e.g. butyldiglycol, butylpentablycol, dimethylformamide, dimethyl sulphoxide, etc. After drying, heat fixing is effected as usual at 50°–120° C. and the temperarily stuck suede is again raised in the dry state with a hard brush.

Leathers treated according to the invention show a very soft, delicate surface with pleasant handle and, compared with untreated goods, a considerable reduced water-absorption capacity and greatly reduced dynamic water absorption.

It is also of particular importance that the said advantageous effects of the treatment according to the invention result both on vegetable-tanned and on chrome-tanned leather, that they are applicable with equally good effect on suede leather of various origin, for example on goat suede leather and pig suede leather, and the leather surfaces obtained show no kind of greasiness but, instead, impart a velvet-like handle to the suede and render it insensitive to hydrophilic dirt and stains which may result from aqueous colourless or coloured liquids, such as e.g. fruit juices, red wine, ink, blood, etc.

The effects which are obtained in the case of the treatment according to the invention on leather, have a very good stability to further after-treatment steps, to water, aqueous detergent solutions and cleaning with organic solvents.

Besides the particularly advantageous effects of the after-treatment according to the invention, the brightening and water-repellent agents to be used according to the invention have an outstanding shelf life and stability in aqueous liquors. The after-treatment process according to the invention for the conditioning and the imparting of water-repellency to leather, as well as the auxiliary agent preparations according to the invention which are used for this process accordingly have a combination of valuable properties which is particularly advantageous industrially and are in this regard substantially superior to hitherto known processes and auxiliary agents.

The following embodiment examples illustrate the preparation and application of the conditioning and water-repellent agents according to the invention as well as the preparation of the N-methylol-N'-alkylureas of the formula I which are contained in the auxiliary agents according to the invention. Parts stated in the present application are parts by weight; percentages stated denote percentages by weight.

EXAMPLE 1

312 g (1 mole) of N-octadecyl-urea are melted under $N_2$ atmosphere at a temperature of 120°–130° C.; 3 g of triethanolamine are added as catalyst, and 39 g (1.3 moles) of paraformaldehyde are added in the course of 1–2 hours. Reaction occurs with heat effect and with dissolving of the parformaldehyde. The crude product obtained has a melting point range of 60°–62° C.; after recrystallisation from dioxan, an m.p. of 67°–69° C.

Yield: 338 g; Analysis: HCHO (bound); calculated: 8.77% with reference to 1 mole; found: 10.2%~1.16 moles —$CH_2OH$— groups; free HCHO<0.1%

NMR data of the product taken up, solvent $CDCl_3$:

3 H—$CH_3$ group at 0.9 ppm
32 H—($CH_2$) groups at 1–2 ppm
2 H—$CH_2$—NH—C(=O)— at 3.2 ppm
2 H—NH—$CH_2$—O— at 4.5 ppm
3 H - mobile

EXAMPLE 2

(a) 30 g of the N-methylol-N'-octadecylurea prepared in Example 1 are melted at a temperature of 90°–100° C. with 6 g of a reaction product of 2,4,6-tri-tert.-butylphenol with 9 moles of ethylene oxide and 1.5 g of an epoxide wax which has been prepared through oxidation of a $C_{30}$-α-olefin. Stirring is then effected intensively for 20 minutes with a high-speed stirrer and 112.5 ml of warm water are slowly added. Afterhomogenisation is then effected for 1 hour at 60°–70° C., followed by precipitation to 20°–30° C. in the bath.

The emulsion obtained is distinguished by an outstanding stability in storage.

If, for the preparation of the emulsion, there is used, instead of the reaction product used above of 2,4,6-tri-tert.-butylphenol with 9 moles of ethylene oxide, the same amount of the reaction product of 2,4,6-tri-tert.-butylphenol with 25 moles of ethylene oxide there is obtained a product with an extremely short stability in storage of, at the most, one day. Instead of 2,4,6-tri-tert.-butylphenol 2,4,6-tri-isobutylphenol or 2,4,6-tri-n-butylphenol can be used with similar effects.

According to the following paragraphs (b) and (c), conditioning agents according to the invention with excellent technical service properties, such as pourability, emulsion stability and effectiveness, are likewise obtained.

(b) 30 g of the reaction product obtained according to Example 1 are melted at a temperature of 90° to 100° C. with 7.5 g of a reaction product of 1 mole of oleyl alcohol with 10 moles of ethylene oxide, and 112.5 ml of warm water are stirred in with a high-speed stirrer. Subsequently, stirring is continued for 1 hour at 90°–100° C. and then, with slow cooling, the emulsion obtained is precipitated to a temperature of 20°–30° C.

(c) In the same manner, it is possible, instead of the reaction product of oleyl alcohol with 10 moles of ethylene oxide, to effect melting with the same amount of a reaction product of oleyl alcohol with 8 moles of ethylene oxide, or of oleyl alcohol with 13 moles of ethylene oxide.

EXAMPLE 3

44.85 g (0.152 mole) of octadecylisocyanate are dissolved in 269.1 ml of technical-grade toluene and 2.6 g (0.152 mole) of gaseous $NH_3$ are introduced at 35°–40° C. until there is an alkaline reaction of the mixture. Thereafter, 0.35 g of triethanolamine, 11.25 g of a reaction product of oleyl alcohol with 10 moles of ethylene oxide and 17.54 g (0.228 mole) of 39% strength aqueous HCHO solution are added and heating to reflux is effected. Heating to the boil under reflux is then effected for 2 hours and 13.1 ml of $H_2O$ are subsequently distilled off on a water separator. Finally, from the reaction product obtained the toluene is distilled off quantitatively, first under normal pressure and lastly in a water-jet vacuum at 14–15 mm Hg.

m.p. 52°–57° C.; Yield: 63.7 g Analysis: HCHO (bound): found 8.3%~methylolation degree 1.2; calculated on product with emulsifier; free HCHO<0.1%

36 g of the product so prepared are melted at a temperature of 90° to 100° C. with 1.5 g of an epoxide wax, which has been prepared by epoxidation of a $C_{30}$-α-olefin, and at this temperature slow stirring together with 112.5 ml of $H_2O$ is effected. Stirring is then continued for a further 1 hour with a high-speed stirrer and the finely disperse emulsion which is formed is stirred out to room temperature.

EXAMPLE 4

47.8 g (0.2 mole) of tetradecylisocyanate are dissolved in 280 ml of technical-grade toluene, and 3.4 g (0.2 mole) of gaseous $NH_3$ gas are introduced at a temperature of 35°–40° C. until there is an alkaline reaction of the mixture (pH value, measured in the toluene/$H_2O$ mixture, 9.5).

0.35 g of N-dimethylethanolamine, 23.08 g (0.3 mole) of aqueous 39% strength formaldehyde solution and 11.95 g of a reaction product of tallow fatty alcohol with 14 moles of ethylene oxide are now added. Heating to the boil under reflux is then effected for 4 hours and 17 ml of water are subsequently separated off on a water separator. The solvent toluene is completely distilled off, first at normal pressure and later in a vacuum.

m.p. 47°–49° C.; Yield: 72 g; Analysis: HCHO (bound); found: 11.96%~methylolation degree 1.5; calculated on crude product with emulsifier 30 g of the distillation residue obtained are melted at a temperature of 60° to 70° C. and adjusted to a final content of 20% through addition of 120 ml of hot water.

An emulsion of the same technical service properties is obtained when, instead of the ethoxylated tallow fatty alcohol, the reaction product of a synthetic alcohol with an alkyl chain of $C_9$–$C_{12}$ and 10 moles of ethylene oxide are used as emulsifier.

EXAMPLE 5

80.75 g (0.25 mole) of eicosylisocyanate are dissolved in 350 ml of technical-grade toluene and, at a temperature of 50°–60° C., 4.25 g (0.25 mole) of liquid $NH_3$ are slowly added, in a pressure vessel, with stirring. After an after-stirring period of 30 minutes, the N-eicosylurea is isolated.

This intermediate product, after suspension in 200 ml of toluene, is transferred into a 500 ml three-necked flask with stirrer and thermometer and reflux condenser. 31 g of the sulphuric acid semi-ester of a reaction product of 1 mole of stearyl alcohol with 12 moles of ethylene oxide, 0.2 g of N-methylmorpholine and finally 27 g (0.35 mole) of aqueous 39% strength formaldehyde solution are now added. Heating to the boil under reflux is then effected for 4 hours; subsequently, the $H_2O$ and the solvent are distilled off.

The crude melt obtained which contains emulsifier is converted into a 30% strength aqueous emulsion through addition of hot $H_2O$ with vigorous stirring with a highspeed stirrer.

In the same manner, a preparation for the conditioning and imparting of water-repellency to leather may be produced from the above described intermediate product and 200 ml of toluene with addition of 31 g of the sulphuric acid semi-ester of a reaction product of 1 mole of stearyl alcohol with 12 moles of ethylene oxide, 58.7 g of a 70% strength sulphonated fish oil (®Derminollicker NBR, HOECHST AG), 0.2 g of N-methylmorpholine and 27 g (0.35 mole) of 39% strength aqueous formaldehyde solution.

This preparation is distinguished by an excellent stability in storage and outstanding handle improvement of the leathers without a so-called "greasiness" being observed on the treated materials.

EXAMPLE 6

140.4 g (0.4 mole) of docosylisocyanate are dissolved in 400 ml of xylene, and 6.8 g (0.4 mole) of gaseous $NH_3$ gas are introduced until there is an alkaline reaction of the mixture (pH value, measured in a toluene/$H_2O$ mixture, 9.2).

1.5 g of triethanolamine are now added and subsequently 34.6 g (0.45 mole) of 39% strength aqueous formaldehyde solution are added. Heating to the boil under reflux is then effected for 4 hours, after which water and the xylene are distilled off.

Yield: 157 g crude product; N-docosyl-N'-methylolurea; Analysis: HCHO (bound); found: 7.6% corresponding to a methylolation degree of 1.0;

100 g of the methylol-docosyl-urea obtained in the manner described above with a methylolation degree of 1.2 are melted at a temperature of 80°–85° C. with 5 g of the triethanolamine salt of the sulphuric acid half-ester of a reaction product of oleyl alcohol and 13 moles of ethylene oxide as well as with 20 g of the reaction product of stearyl alcohol and 14 moles of ethylene oxide. 475 ml of hot water of 70°–80° C. are then stirred into this homogeneous melt, with good stirring with a highspeed stirrer.

An emulsion according to the invention for imparting water repellency to, and improving the handle of, leather and which has outstanding technical service properties is obtained.

EXAMPLE 7

In the following Examples which illustrate the application of the auxiliary agent preparation according to the invention, the amounts used which are stated in % are referred to leather dry weight.

10 after-chromed, East Indian bastard clothing suede leathers with a dry weight of 2.6 kg are milled for about 1 hour with 100% of $H_2O$, 2% of $NH_4OH$ and 0.1 to 0.2% of an anionic emulsifier. Subsequently, the leathers are rinsed for five minutes with water of 20°–25° C. and milled for one hour in a tanning drum with 100–200% of water, 1 to 2% of ammonia, 25% strength, and 10% of the auxiliary agent preparation according to the invention described in Example 1. After this time, the amount of water is increased to a total of 1000% and heating to 60°–70° C. is effected.

In this bath the leathers are dyed as usual with anionic dyestuffs and then acidified with formic acid; the amount of acid should not lie below 2%.

The leathers, without rinsing, are laid on a horse for 24 hours, then dried at 60°–70° C. and, finally, milled for 3–4 hours in a milling drum.

The leathers so treated show a silky, smooth suede handle and have a good gloss effect.

Applied water drops, in the case of a leather treated in this manner, do not penetrate within 4 hours, compared with a penetration time of two to four minutes in the case of an untreated leather.

The dynamic water absorption according to the small disk method is reduced from 140–150% in the case of an untreated leather to 45–35%.

Working instruction for the determination of the dynamic water absorption of leather according to the small disk method:

For the determinations, comparable leather pieces are always used which, as far as possible, have been cut out of one piece of leather beside one another.

In each case 3 small disks of leather of 20 mm diameter are punched out of a test piece. The cut surfaces of the small disks are provided with a nitrocellulose lacquer, dried and each piece is weighed individually.

Subsequently, the 3 leather test pieces are placed in a 500 ml shaking bottle which contains 250 ml of desalinated water of 20° C. and shaking is effected for 15 minutes in the shaking apparatus (shaking frequency: 180 min.$^{-1}$).

After the shaking, the test pieces are dabbed off with filter paper and weighed.

Calculation of the water absorption as a percentage:

% water absorption $=(G_{wet}-G_{dry}\cdot 100/G_{dry}$ $G_{wet}$ = weight of the wet leather $G_{dry}$ = weight of the dry leather.

EXAMPLE 8

20 halves of intermediately dried, chrome-tanned split suede leather with a dry weight of 60 kg are milled with 1000% of water of 35° C., 2% of $NH_3$, 25% strength, and 0.2–0.4% of an anionic emulsifier for about 1 hour in a tanning drum. Subsequently, the leathers are rinsed with water of 20°–25° C. for about 5 minutes and treated with 100–200% of water, 1–2% of ammonia, 25% strength, and 5–10% of the auxiliary agent preparation produced according to Example 3. The pH value at the end of the treatment should lie between 6 and 9. After this time, there is added, depending on the desired shade, 4–8% of dyestuff, in powder form, and, after a dyeing duration of 30–45 minutes, the total liquor is increased to 800–1000%, heated to 60°–70° C. and, after a further 30 minutes' running time, acidified as usual with formic acid. The amount of formic acid should be half the amount of dyestuff used.

The treated leathers are, without rinsing, hung over a horse for about 24 hours, then dried at 60°–70° C. and finished as usual.

The split suede leathers so treated show a soft, velvet-like suede handle and have a good gloss effect.

The penetration time of applied water drops is improved from 5–10 minutes in the case of an untreated leather to two to three hours. The dynamic water absorption according to the small disk method is reduced from 80–100% in the case of an untreated leather to 20 to 30%. This water-repellency effect may be increased still further through an additional hydrophobic fat liquoring.

EXAMPLE 9

10 halves of a shave-moist, chrome-tanned cowhide upper leather with a leather thickness of 0.8 to 1 mm are, in usual manner, neutralised, high-tanned, dyed and rendered water-repellent through fat-liquoring.

As final treatment, 1–3% of the auxiliary agent preparation according to the invention described according to Example 6 are added to the acidified dyeing and fat-liquoring bath which has a temperature of about 60°–70° C. Before the addition of this auxiliary agent preparation, the auxiliary agent is diluted with water of 20°–30° C. in the weight ratio 1:3 and adjusted with ammonia, 25% strength, to a pH value of 7.7–8.0.

The running time in the milling drum is about 10–20 minutes.

After this time, the treated leathers are, without rinsing, hung over a horse and finished as usual.

Through this final treatment with the reactive auxiliary agent according to the invention, which treatment is to be regarded as top fat-liquoring, these leathers receive a wax-like, warm surface handle with a simultaneous water-repellent finish.

The penetration time of water drops is increased by this final treatment from 1–2 minutes to 1–2 hours.

EXAMPLE 10

Chrome-tanned, dyed cowhide leathers which have been finished in the usual manner and are intended for furniture coverings are dressed with a finish consisting of thermoplastic copolymers with organic and inorganic pigments. The application of these products is effected with a spray gun. In order to achieve a good abrasion resistance and a good water fastness which are demanded by technical service, these leathers additionally receive a final coating with nitro lacquers emulsified in aqueous systems.

Into 100 g of emulsion lacquer for the final treatment of chrome leather there are stirred 10–20 g of an auxiliary agent preparation produced according to Example 3; adjustment to pH 8.0–9.0 is effected with ammonia, 25% strength, followed by dilution to a ready-to-spray concentration with 100 parts of water of 20° C. After 2 spray applications, the treated leathers are dried and subsequently finally pressed with a hydraulic tailor's press at 70°–80° C. and 80–150 atmospheres gauge pressure.

The leathers so obtained are considerably superior in regard to abrasion fastness and water fastness to leathers which were after-treated with the same lacquer system but without addition of the product from Example 3.

EXAMPLE 11

Normally-dyed chrome split suede leather (4 g milling weight) with a thickness of 1.5 mm is treated in a continuous multi-purpose machine at 60° C. with an impregnation liquor of 50 g/liter of the emulsion prepared according to Example 2 and 20 g/liter of a 70% strength sulphonated fish oil (®DERMINOL LICKER NBR, Höchst AG). The passage time of the leather was 10 seconds at a belt speed of 3 m/minute.

After squeezing to 980 g liquor absorption, the leather was now dried as usual with hot air at 80° C., heat-fixed on a tailor's press at 95° C., 30 atmospheres gauge pressure, for 5 seconds and, as usual, after-buffed on a rotating buffing machine with grinding paper, granulation 220.

A velvet-like suede handle with pleasant "write effect" and a good water-repellency effect on the processed material are obtained.

With the preparations according to the invention which are stated in the following Table, outstanding conditioning and water-repellency effects can be obtained in the same manner on high-quality leather.

| Active substance basis | Methylol groups/ molecule | Emulsifier constituents | % proportion | Weight ratio Active substance/ Emulsifier/ $H_2O$ |
|---|---|---|---|---|
| N-octadecyl-N'-methylol-urea | 1 | $CH_3-(CH_2)_7-CH=CH-(CH_2)_7-CH_2(OCH_2-CH_2)_{10}-OH$ | 5 | 20:5:75 |
| N-octadecyl-N'-methylol-urea | 1.2 | $C_9H_{19}/C_{12}H_{23}(-OCH_2-CH_2)_{13}-OH$ | 3 | 18:3:79 |
| N-stearyl-N'-methylol-urea | 1.5 | $C_{17}H_{33}-CO-NH-CH_2-CH_2-SO_3^{\ominus}Na^{\oplus}$ | 1 | 22:1:77 |
| N-stearyl-N'-methylol-urea | 1 | $CH_3-(CH_2)_7-CH=CH-(CH_2)_7-CH_2(OCH_2-CH_2)_{13}-OH$ | 4.5 | 20:5:75 |
| | | $C_{17}H_{33}-CO-NH-CH_2-CH_2-SO_3^{\ominus}Na^{\oplus}$ | 0.5 | |
| N-stearyl-N'-methylol-urea | 1.2 | $CH_3-(CH_2)_{17}-(OCH_2-CH_2)_8-OH$ | 2.5 | 17:4.5:78.5 |
| | | $CH_3-(CH_2)_7-CH=CH-(CH_2)_7-CH_2-(OCH_2-CH_2)_{13}-OSO_3^{\ominus}\ {}^{\oplus}NH(CH_2-CH_2OH)_3$ | 2.0 | |
| N-tetra-decyl-N'-methylol-urea | 1.0 | tallow fatty alkyl$-(OCH_2-CH_2)_{14}OH$ | 1.0 | 20:4:76 |
| | | $C_9H_{19}-C_6H_4-(OCH_2-CH_2)_{12}-OSO_3^{\ominus}NH_4^{\oplus}$ | 3.0 | |

-continued

| Active substance basis | Methylol groups/ molecule | Emulsifier constituents | % proportion | Weight ratio Active substance/ Emulsifier/ $H_2O$ |
|---|---|---|---|---|
| N-hexadecyl-N'-methylol-urea | 1.3 | coconut fatty alkyl—$(OCH_2—CH_2)_{14}$—OH | 2.0 | 10:4:86 |
| | | 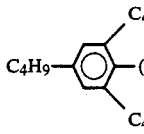 | 2.0 | |
| N-eicosyl-N'-methylol-urea | 1.2 | $CH_3—(CH_2)_{15}—CONH—CH_2—CH_2—SO_3^{\ominus}Na^{\oplus}$ | 2.5 | 20:5:75 |
| | | $CH_3—(CH_2)_7—CH=CH—(CH_2)_7—CH_2(OCH_2—CH_2)_{14}—OH$ | 2.5 | |
| N-eicosyl-N'-methylol-urea | 1 | $CH_3—(CH_2)_{14-16}—CON(CH_3)—CH_2—CH_2SO_3^{\ominus}NH_4^{\oplus}$ | 1.0 | 12.5:2:85.5 |
| | | 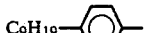 | 1.0 | |
| N-docosyl-N'-methylol-urea | 1.5 | $CH_3—(CH_2)_7—CH=CH—(CH_2)_7—CH_2(OCH_2—CH_2)_{12}—OH$ | 2.5 | 18:4.5:77.5 |
| | | $CH_3—(CH_2)_7—CH=CH—(CH_2)_7—CH_2(OCH_2—CH_2)_{12}—OSO_3^{\ominus}NH_4^{\oplus}$ | 2.0 | |
| N-stearyl-N'-methylol-urea + N-eicosyl-N'-methylol-urea | 1 | $CH_3—(CH_2)_7—CH=CH—(CH_2)_7—CH_2—(OCH_2—CH_2)_{14}—OH$ | 4 | 20:4:76 |
| N-coconut fatty N'-methylol-urea + N-eicosyl-N'-methylol-urea | 1.3 | coconut fatty $(OCH_2—CH_2)_{14}$—OH | 1.5 | 20:2:78 |
| | | $CH_3—(CH_2)_{16}—CO—N(CH_3)—CH_2—CH_2—SO_3^{\ominus}Na^{\oplus}$ | 0.5 | |
| N-tallow fatty N'-methylol-urea + N-eicosyl-N'-methylol-urea | 1.2 | tallow fatty alkyl—$(OCH_2—CH_2)_{10}$—OH | 2.0 | 15:2.5:82.5 |
| | | tallow fatty alkyl—$(O—CH_2—CH_2)_{10}—OSO_3^{\ominus}Na^{\oplus}$ | 0.5 | |
| N-octadecyl-N'-methylol-urea | 1.4 | $CH_3—(CH_2)_7—CH=CH—(CH_2)_7—CH_2(OCH_2—CH_2)_{10}—OH$ | 1.0 | 22:2:76 |
| | | 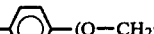 | 1.0 | |
| N-stearyl-N'-methylol-urea | 1 2 | $CH_3—(CH_2)_{17}—(OCH_2—CH_2)_{14}—OH$ | 1.5 | 20:2.5:77.5 |
| | | $CH_3—(CH_2)_7—CH=CH—(CH_2)_7—CH_2—OSO_3^{\ominus}NH^{\oplus}(CH_2—CH_2OH)_3$ | 1.0 | |
| N-octadecyl-N'-methylol-urea | 1.5 | tallow fatty alkyl—$(OCH_2—CH_2)_{10}$—OH | 0.5 | 24:1:75 |
| | | 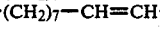 | 0 5 | |

We claim:

1. Conditioning and water-repellent agent for leather comprising a homogeneous mixture of (a) 10 to 35% by weight of a substance of the formula $$R—NH—\underset{\underset{O}{\|}}{C}—NH_n(CH_2OH)_m$$

wherein R is linear or branched alkyl or alkenyl each having 14 to 22 carbon atoms, m is a number average from 1.0 to 1.5 and n is 2 minus m;

(b) 0 to 10% by weight of non-ionic emulsifiers;

(c) 0 to 3% by weight of anionic emulsifiers with the proviso that the sum of (b) and (c) is 0.5 to 10%;

(e) 5 to 25% by weight of fat liquors; and (f) 25 to 89.5% by weight of water or a water-miscible organic solvent.

2. Conditioning and water-repellent agent according to claim 1 wherein component (a) comprises 10 to 25% by weight of the mixture, component (b) comprises 0 to 5% by weight of the mixture, component (c) comprises 0 to 3% by weight of the mixture with the proviso that the sum of (b) and (c) is 1 to 5% by weight, and component (f) comprises 40 to 89.0% by weight of the mixture.

3. Conditioning and water-repellent agent according to claim 1 wherein the compound of component (a) R is selected from the group consisting of stearyl, coconut fatty alkyl, tallow fatty alkyl, oleyl, eicosyl and docosyl.

4. Conditioning and water-repellent agent according to claim 1 wherein non-ionic emulsifiers of (b) comprise $$A—(OCH_2—\underset{\underset{R^4}{|}}{CH})_n—OH$$

wherein

A is unbranched alkyl having 10 to 22 carbon atoms, alkenyl having 10 to 22 carbon atoms, or alkylphenyl, dialkylphenyl or trialkylphenyl with a total of 4 to 12 carbon atoms in the alkyl moieties;

$R^4$ is hydrogen, methyl or ethyl; and n is an integer from 8 to 14.

5. Conditioning and water-repellent agent according to claim 4 wherein A is selected from the group consisting of stearyl, coconut fatty alkyl, tallow fatty alkyl and oleyl; and $R^4$ is hydrogen.

6. Process for the preparation of conditioning and water-repellent agents for leather as defined in claim 2 comprising the steps of methylolating (a·M)/(M+30m) parts by weight of a urea of the formula $$R—NH—CO—NH_2$$

with at least an m-fold molar amount of paraformaldehyde, calculated as formaldehyde, in the melt or aqueous formaldehyde solution in the presence of a water-immiscible inert solvent in the presence of h parts by weight of non-ionic emulsifiers, and p parts by weight of anionic emulsifiers;

removing by distillation any water-immiscible inert solvent and homogenizing the residue in the plastic or molten state with (b-h) parts by weight of non-ionic emulsifiers, (c-p) parts by weight of anionic emulsifiers, and e parts by weight of fat liquors wherein a is 10 to 35, b is 0 to 10, c is 0 to 3, b+c is 0.5 to 10, e is 5 to 25, h is less than or equal b and p is less than or equal c; and subsequently f parts by weight of water or a water-miscible organic solvent are added with constant intermixing and homogenization wherein f is 25 to 89.5 and the sum of a+b+c+e+f is 100.

7. Process according to claim 6 wherein R of said urea is selected from the group consisting of stearyl, coconut fatty alkyl, tallow fatty alkyl and oleyl.

8. Process according to claim 6 wherein said non-ionic emulsifiers are of the formula $$A—(OCH_2—\underset{\underset{R^4}{|}}{CH})_n—OH$$

wherein

A is unbranched alkyl having 10 to 22 carbon atoms, alkenyl having 10 to 22 carbon atoms, or alkylphenyl, dialkylphenyl or trialkylphenyl with a total of 4 to 12 carbon atoms in the alkyl moieties;

$R^4$ is hydrogen, methyl or ethyl; and n is an integer from 8 to 14.

9. Process according to claim 8 wherein A is selected from the group consisting of stearyl, coconut fatty alkyl, tallow fatty alkyl and oleyl; and $R^4$ is hydrogen.

10. Process according to claim 6 wherein homogenization of the constituents and the water or water-miscible organic solvent is effected at temperatures of 40° to 100° C.

11. A method of conditioning and imparting water-repellency to leather comprising applying an agent according to claim 1 to said leather.

* * * * *

UNITED STATES PATENT AND TRADEMARK OFFICE

CERTIFICATE OF CORRECTION

PATENT NO. : 4,289,665

DATED : September 15, 1981

INVENTOR(S) : Gustav Hudec et al

It is certified that error appears in the above-identified patent and that said Letters Patent are hereby corrected as shown below:

| Column | Line | Correction |
|---|---|---|
| 5 | 43 | Formula should read: $CH_3-(CH_2)_{16}-CO-O-CH_2-CH_2-SO_3^{\ominus}\,Na^{\oplus}$ and |
| 5 | 46 | Formula should read: $CH_3-(CH_2)_7-CH=CH-(CH_2)_7-CO-O-CH_2-CH_2-SO_3^{\ominus}\,Na^{\oplus}$; |
| 5 | 49 | Formula should read: $CH_3-(CH_2)_{16}-CO-NH-CH_2-COO^{\ominus}\,Na^{\oplus}$; |

Signed and Sealed this

Eighteenth Day of May 1982

[SEAL]

Attest:

GERALD J. MOSSINGHOFF

Attesting Officer

Commissioner of Patents and Trademarks